US005765340A

United States Patent

Ekblom

[11] Patent Number: 5,765,340

[45] Date of Patent: Jun. 16, 1998

[54] METHOD AND APPARATUS FOR WRAPPING A ROLL

[75] Inventor: Karl Ekblom, Appleton, Wis.

[73] Assignee: Valmet Corporation, Helsinki, Finland

[21] Appl. No.: 670,344

[22] Filed: Jun. 25, 1996

[51] Int. Cl.[6] ..... B65B 13/04

[52] U.S. Cl. ..... 53/399; 53/582; 53/587

[58] Field of Search ..... 53/399, 176, 587, 53/582, 211, 137.2

[56] References Cited

U.S. PATENT DOCUMENTS

| | | | |
|---|---|---|---|
| 2,893,189 | 7/1959 | Lancaster | 53/587 |
| 2,893,191 | 7/1959 | Lancaster . | |
| 3,853,051 | 12/1974 | Tyler | 53/137.2 |
| 3,863,425 | 2/1975 | Edwards et al. | 53/211 |
| 4,341,586 | 7/1982 | Koutonen | 53/211 X |
| 4,534,151 | 8/1985 | Schneck et al. | 53/137.2 X |
| 4,596,108 | 6/1986 | Piesen et al. | 53/211 |
| 4,736,567 | 4/1988 | Pienta | 53/587 X |
| 4,882,892 | 11/1989 | Pienta . | |
| 5,046,298 | 9/1991 | Norkoski et al. . | |

FOREIGN PATENT DOCUMENTS

| | | | |
|---|---|---|---|
| 2182044 | 2/1997 | Canada . | |
| 2184857 | 3/1997 | Canada . | |
| 0 394 579 | 10/1990 | European Pat. Off. . | |
| 2617122 | 12/1988 | France | 53/211 |
| 40 34 757 A1 | 5/1991 | Germany . | |
| 195 30 257 A 1 | 2/1997 | Germany . | |

OTHER PUBLICATIONS

PCT Search Report for PCT Application No. PCT/FI 97/00322.

*Primary Examiner*—Linda Johnson

*Attorney, Agent, or Firm*—Cohen, Pontani, Lieberman, Pavane

[57] ABSTRACT

A method and apparatus for wrapping cardboard and paper rolls for protection during shipping and handling. The rolls are wrapped in a strip of wrapping material, that has a width which does not exceed the length of the roll. The roll is transferred to the wrapping station on a transporter and is stopped using a mechanical positive stop so that a edge of the cylindrical part of the roll is aligned with a first edge of the wrapper roll mounted in the wrapping station. When the roll is stopped, a first layer of the wrapper is wound on the roll. Then, if the length of the roll is greater than the width of the wrapper, the relative position of the roll and the wrapper is changed so that the second edge of the cylindrical part of the roll is aligned with the second edge of the wrapper roll, and a second layer of wrap is wound on the roll.

14 Claims, 2 Drawing Sheets

METHOD AND APPARATUS FOR WRAPPING A ROLL

FIELD OF THE INVENTION

The present invention relates to a method and apparatus for wrapping cardboard and paper rolls for protection during shipping and handling. More particularly, the invention relates to an apparatus for wrapping rolls with a wrap of paper or cardboard.

BACKGROUND OF THE INVENTION

Paper and cardboard rolls are very delicate and are damaged quite easily during shipping. To avoid damage to the rolls, they are wrapped with a durable cover that protects the rolls from moisture and mechanical damage. The cover is made of thick paper or cardboard, which can be covered with plastic coating, or is comprised of a sandwich structure. The paper rolls are usually packaged into a wrapper that extends over the ends of the roll. The ends of the wrapper are crimped around the ends of the roll, and the ends are covered with circular end heads which are glued or heat sealed on to the crimped part of the wrapper.

However, with respect to cardboard rolls, end heads are not normally used in packaging, and the ends remain open because most cardboard grades substantially withstand the moisture and mechanical impacts that the rolls typically experience during transport and storage. When end heads are not used, it is desirable that the edge of the wrapper be close to the edge of the cylindrical body of the roll. The wrapper has to cover the entire cylindrical part of the roll but preferably should not extend over the edge of the cylindrical part of the roll. If the edge of the wrapper extends over the edge of the roll, the wrapper can tear easily, especially when the rolls are stacked on end on top of one another, which is common in the roll manufacturing industry and in the storage of rolls.

To prevent tearing of the wrapper, the ends of the wrapper have to be substantially flush with the edges of the cylindrical part of the roll. This sizing of the wrapper can be accomplished either by cutting the wrapper to a desired width before the wrapping is wound over the roll or by cutting the excess part of the wrapping extending over the end of the roll after the roll has been wrapped. Cutting the edges of the wrapping after the wrap is wound over the roll is difficult to implement as the edge of the cylindrical part of the roll is easily damaged during such cutting. Therefore, it is desirable to trim the edge of the wrapper so that it does not extend over the edge of the cylindrical part of the roll after wrapping.

U.S. Pat. No. 5,046,298 describes a method and apparatus for wrapping a roll with a stretch wrap. According to this method, the edges of the wrap are trimmed before the wrap is wound over the roll. The method, which is used for wrapping rolls made of paper, requires that the ends of the roll are covered with end heads. The edges of the cylindrical part of the roll are covered with a stretch wrap that seals the open seam between the wrap and the end head. The width of the roll is detected so that the sleeve wrapper can be cut to correspond substantially to the width of the roll before the sleeve wrap is wrapped around the roll. The sleeve wrap is cut by a trim slitter which trims the sleeve wrap to the same size as the width of the roll. As sleeve wrap stock is fed down through the wrapper dispenser feed device, the sleeve wrap is directed onto a table, which includes a vacuum belt for holding the sleeve wrap tightly against the table. As the sleeve wrap travels down the table, a trim slitter blade located on each side of the table trims the wrap to the same size as the width of the roll before the sleeve wrap is wrapped around the roll. Sensing means used in connection with the trim slitter blades are adjusted to correspond to the width of the roll.

Although the above described method could be used for wrapping cardboard rolls so that the use of the end heads and the stretch wrap can be omitted, this method has a number of drawbacks. First, the wrapper used in the method has to be wide since it extends at least over the entire length of the roll to be wrapped. If the length of the rolls to be wrapped is significantly variable, to ensure that all lengths of rolls can be wrapped, a large amount of material will have to be cut from the sides of the wrapper for wrapping rolls of shorter lengths. This wrapper cutting leads to a direct waste of the wrapper material, and more importantly, to a need for waste handling equipment to transport the cuttings to a pulper. The cuttings are transported normally by air tubes or transporters since the pulpers are typically located at manufacturing stations far remote from the packaging stations. Because of the long transportation distance, the costs associated with the use of waste handling equipment is considerable. Also, in some cases, the waste cannot be recycled. For example, the wrapping may be coated with a plastic material. Also, the wrapper cannot be fed into the paper making process since doing so may change the quality of the paper produced, for example, brown paper wrapping material cannot be fed into a white paper making process. In such a case, the cuttings must be baled and handled some other way.

The cutting mechanism used for trimming the edges of the wrapper also increase the cost of the wrapping station as well as the costs for service and maintenance. The positioning of the cutting blades does not have to be very accurate, since the wrapper can be cut slightly narrower than the length of the roll because the ends of the roll are wrapped with a stretch wrap. In this apparatus, the roll itself cannot be positioned along to the edge of the wrapper because such positioning would require accurate measurement of the location of the roll.

The mechanism for moving the roll should also be capable of moving the roll accurately.

SUMMARY OF THE INVENTION

According to the present invention, a roll is wrapped with a wrap that has a width which does not exceed the length of the roll. The roll is transferred to the wrapping station using a transporter and is stopped using a mechanical positive stop so that a edge of the cylindrical part of the roll is aligned with a first edge of the wrapper roll on the wrapping station. When the roll is stopped, a first layer of wrapping, which may comprise several rounds of wrapper material, is wound on the roll. Next, if the length of the roll is greater than the width of the wrapper, the relative position of the roll and the wrapper is changed so that the other edge of the cylindrical part of the roll is aligned with the other edge of the wrapper roll on the wrapping station, and a second layer of wrapper is wound on the roll.

According to a preferred embodiment of the present invention the roll is moved in the second stage against a second mechanical stopper so that the second edge of the cylindrical part of the roll is aligned with the second edge of the wrapper roll on the wrapping station and a second layer of wrapper is wound on the roll.

Further, if the length of the roll is greater than two widths of the wrapper, a third layer of wrapping is wound on the roll between the first and second layers. A third or fourth layer may be wrapped on the roll for other purposes also. For example, if a printed wrapper is used, a third layer may be used to give the wrapped roll a desired appearance.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views.

DETAILED DESCRIPTION OF THE PRESENTLY PREFERRED EMBODIMENTS

Figure 1:
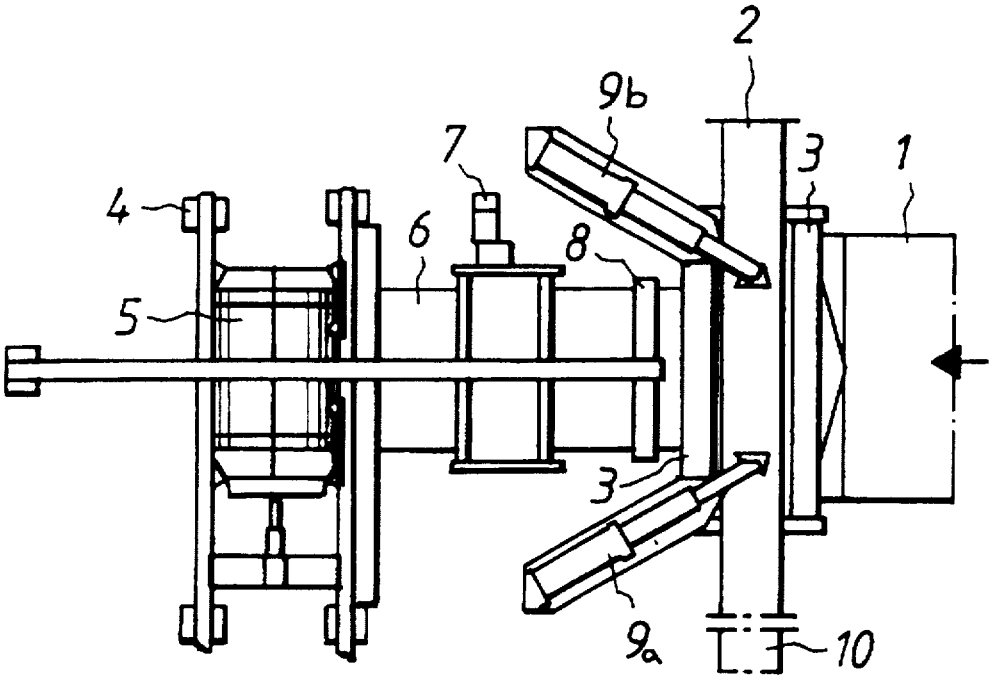
FIG. 1 shows diagrammatically the first embodiment of an apparatus according to the invention.

In FIG. 1 is shown a wrapping station to which the rolls to be wrapped roll down a ramp 1. On the station, the roll is stopped on a short hoistable transporter 2. Two support rollers 3 are positioned on opposite sides of the transporter 2. At the side of the ramp 1 opposite to the ramp 1 is a means for feeding the wrapper on to the roll to be wrapped. This feeding means comprises a support frame 4 for holding a wrapper roll 5, a drive roll 7 for dispensing the wrapper 6 from the wrapper roll 5, and an apparatus 8 for cutting the end of the wrapper 6 transversely or obliquely to a desired length and for applying glue to the end of the wrapper 6. Above the support rollers 3 along both sides of the path of the wrapper 6 are mechanical stoppers 9*a*, 9*b* for positioning the roll to be wrapped on the transporter 2. At one end of the hoistable transporter 2 is a second transporter 10 for further transporting the roll after it has been wrapped.

The mechanical stoppers 9*a*, 9*b* in this embodiment are powered with pneumatic cylinders which are positioned at an angle above the support rollers 3. The arms of the stoppers 9*a*, 9*b* can be actuated to extend into the path of the roll 11 as it travels on the transporter 2 so that they stop movement of the roll 11 on the transporter, as shown in FIGS. 2 and 3.

The above described wrapping station operates as follows. The width of the strip of wrapping material or wrapper used is normally substantially the same as the length of the shortest roll to be wrapped or packaged. The roll 11 arrives at the station by rolling down the ramp 1 and is stopped on the transporter 2 which is initially elevated above the level of the support rollers 3. At this point, the roll 11 is located on the center line of the station and may be transferred in either direction on the transporter 2 during the wrapping process. The stoppers 9*a*, 9*b* are in their home or unextended position and allow the roll 11 travel freely. When one of the ends of the roll 11 has passed a stopper 9*a* as the roll 11 is transported by the transporter 2, this stopper 9*a* is actuated to extend to its stopping position and the direction of the movement of the transporter 2 is changed, thereby also transporting the roll 11 in the opposite direction. The roll 11 moves towards the extended stopper 9*a* until the end of the roll 11 hits the stopper 9*a*, at which point the transporter 2 is stopped and lowered so that the roll 11 rests on the support rollers 3, as shown in FIG. 2. The mechanical stopper 9*a* provides an effective and reliable means for positioning the roll 11.

Figure 2:
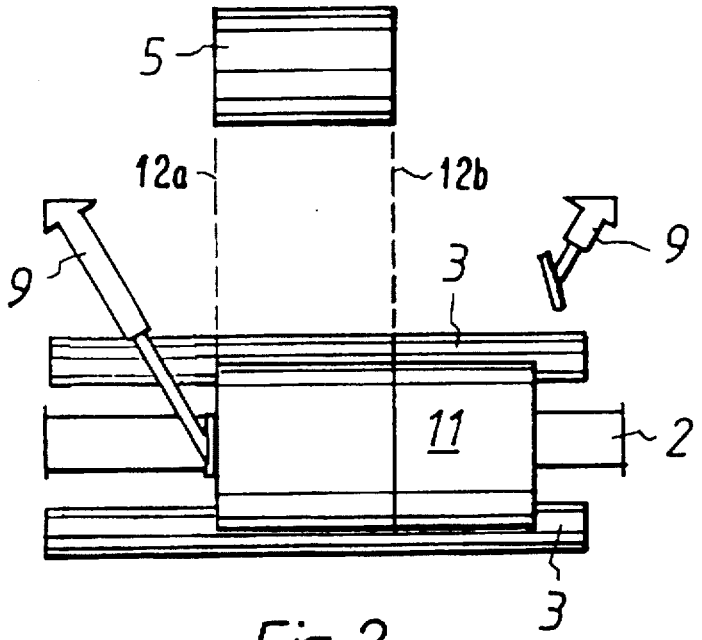
FIGS. 2 and 3 show diagrammatically the operation of the apparatus in FIG. 1.
Figure 3:
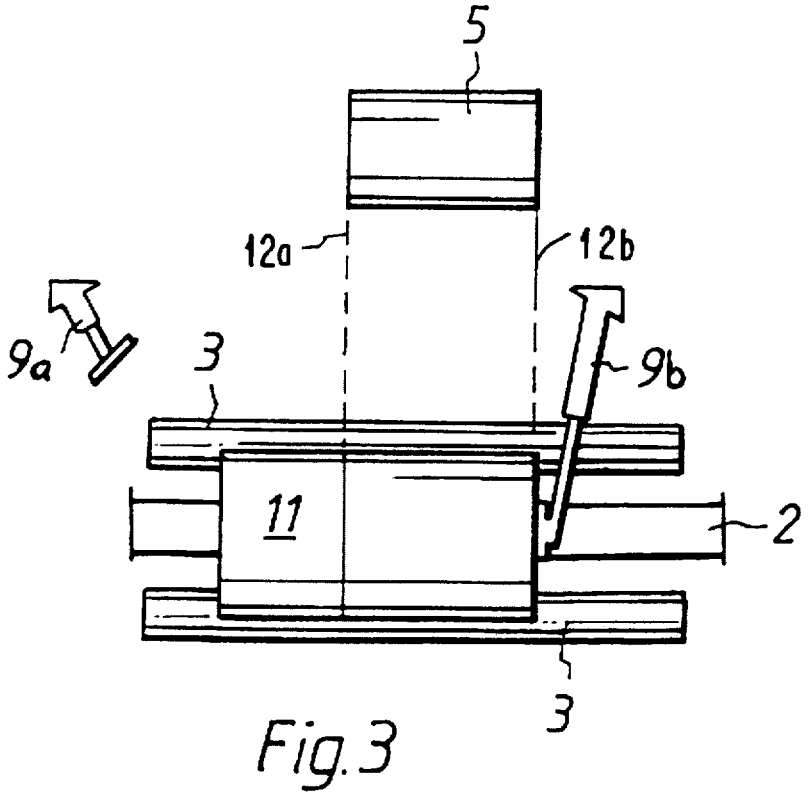

When the roll 11 is stopped, one of its ends is accurately aligned with one of the edges 12*a* of the wrapper 6 drawn from the wrapper roll 5, as shown in FIG. 2. A first layer of wrapping is wrapped onto the roll 11 in a conventional way, and the end of the wrapper is glued and cut with the cutting and gluing apparatus 8. The first layer and every succeeding wrapper layer commonly comprises several wrapper material layers. Next, the first stopper 9*a* is retracted, and the roll 11 is moved with the transporter 2 towards the first stopper 9*a* so that the second end of the roll 11 passes the second stopper 9*b*. The second stopper 9*b* is actuated to extend, and the roll is then moved against it, as shown in FIG. 3. At this point, the unwrapped end of the roll 11 is accurately aligned with the other edge 12*b* of the wrapper 6, the roll 11 is lowered onto the support rollers 3, and the second layer of the wrapper 6 is wrapped onto the roll 11. Normally, two wraps are sufficient to cover the entire roll, but if the length variation of the rolls is large, a third and even fourth layer may be used to cover the entire roll. The width of the wrapper is selected to be equal to the length of the shortest roll, and several wrapping layers may be applied. However, only one width of wrapper is needed, thereby eliminating the need for storing several wrapper rolls of different widths and simplifying the internal logistics in the mill.

Figure 4:
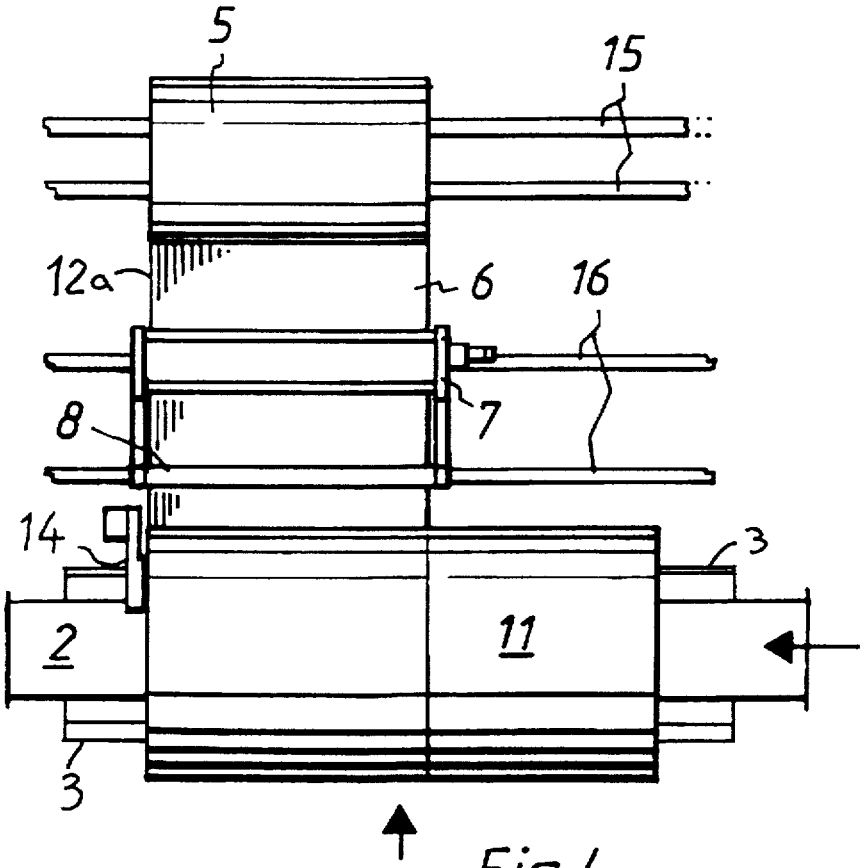
FIG. 4 shows another embodiment of the invention.

In FIG. 4 is shown another embodiment of the present invention. In this embodiment, the wrapping means comprising a wrapper roll 5, a drive roll 7, and a cutting and gluing means 8, each of which is mounted on rails 15, 16. The rolls 11 to be wrapped arrive at the wrapping station on a conveyor 2, which travels between support rollers 3. A mechanical stopper 14 is positioned at the end of the support rollers 3. In this embodiment, the mechanical stopper 14 is a pivoting arm that can be turned clock-wise and counter-clockwise between two positions, one position being such that the pivoting arm blocks the path of travel of the roll 11 transported on transporter 2 and the other position being such that the pivoting arm does not block the path of travel of a roll 11 transported on transporter 2. The wrapping means is mounted onto the rails 15, 16 so that it can be moved along the rails 15, 16 parallel to the support rollers 3 for a distance that is at least as long as the longest roll 11 to be wrapped.

When a roll 11 arrives at the wrapping station, it stops when it hits the arm of the mechanical stopper 14. The end of the cardboard or paper roll 11 is now accurately aligned with the edge 12*a* of the wrapper 6 from the wrapper roll 5, which has been moved on the rails 15 so that the edge 12*a* of the wrapper is positioned to align with the mechanical stopper 14. The transporter 2 lowers the roll 11 onto the support rollers 3, and a first layer of wrapper is wrapped onto the roll 11. Next, the wrapping means is moved on the rails 15, 16 to the other end of the cardboard roll 11 so that the second edge of the wrapper is accurately aligned with the other end of the roll 11, and a second layer of wrapper is wrapped on the roll 11. The end of the roll 11 to be aligned with the second edge of the wrapper is located in an one of many conventional ways such as by using mechanical sensors or electric eyes in conjunction with one or more beams of light. If the roll 11 is very long, the wrapping means is moved again, and a third and a fourth layer may be wrapped on the roll.

The apparatus described in FIG. 4 can be used without changing the position of the roll 11 during wrapping. In this case, the roll 11 is transferred to the wrapping station and halted on the support rollers 3. Before the roll has entered the wrapping station, the wrapping means has been positioned so that the edge 12*a* of the wrapper 6 extends above the end of the roll 11. When the roll 11 is stopped, the wrapping means is moved towards the roll 11, and when the mechanical stopper 14 contacts the end of the roll 11, movement of the wrapping means is stopped, and the first layer of wrapper is wound around the roll 11. After the first layer is wrapped, the wrapping means is repositioned and the second layer is wrapped, as described above.

The mechanical stoppers can be pneumatic or hydraulic cylinders or different types of pivoting or linearly moving arms. The stoppers may also be actuated by electrical means. Instead of a hoistable transporter between the support rollers, hoistable support rollers which can be lifted may be used to lift and support the roll to be packaged above the transporter.

Thus, while there have been shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims hereto.

What is claimed is:

1. A method for wrapping a roll with a wrapping material comprised of one of paper and cardboard to protect the roll during shipping and handling, comprising the following steps in sequence:

a. transporting the roll to be wrapped to a wrapping station, the wrapping station comprising a support roller and a wrapper dispensing and cutting means for dispensing a length of wrapping material from a supply of wrapping material and for cutting the wrapping material;

b. changing the relative position of the roll and the wrapper dispensing and cutting means by moving at least one of the roll and the wrapper dispensing and cutting means until a first edge of the roll is aligned with a first edge of the wrapping material;

c. rotatably supporting the roll on the support roller;

d. wrapping a layer of the wrapping material dispensed from the wrapper dispensing and cutting means onto the roll so that the length of wrapping material is wrapped about the roll perpendicular to an axis of the roll;

e. cutting the wrapping material wrapped on the roll from the supply of wrapping material using the wrapper dispensing and cutting means;

f. changing the relative position of the roll and the wrapper dispensing and cutting means by moving at least one of the roll and the wrapper dispensing and cutting means until a second edge of the roll is aligned with a second edge of the wrapping material;

g. rotatably supporting the roll on the support roller; and h. wrapping a layer of the wrapping material onto the roll so that the wrapping material is wrapped about the roll perpendicular to the axis of the roll.

2. The method of claim 1, wherein the moving of at least one of the roll and the wrapper dispensing and cutting means in at least one of steps (b) and (f) is stopped by a mechanical stopper.

3. The method of claim 1, wherein said roll is moved in steps (b) and (f).

4. The method of claim 1, wherein said wrapper dispensing and cutting means is moved in steps (b) and (f).

5. The method of claim 1, further comprising the following steps in sequence:

i. changing the relative position of the roll and the wrapper dispensing and cutting means by moving at least one of the roll and the wrapper dispensing and cutting means;

j. rotatably supporting the roll on the support roller; and k. wrapping a layer of the wrapping material onto the roll so that a length of the wrapping material is wrapped about the roll perpendicular to the axis of the roll; and repeating steps (i), (j) and (k) until a circumference of the roll is completely wrapped with the wrapping material.

6. An apparatus for wrapping a roll with a wrapping material comprised of one of paper and cardboard to protect the roll during shipping and handling, comprising:

a means for transporting the roll to be wrapped to a wrapping station;

a wrapping station comprising a support roller and a wrapper dispensing and cutting means for dispensing a length of wrapping material to wrap the roll and for cutting the wrapping material, the length of the wrapping material being perpendicular to an axis of the roll;

a means for changing the relative position of the roll and the wrapper dispensing and cutting means to enable at least one of (a) a first edge of the roll to be aligned with a first edge of the wrapping material and (b) a second edge of the roll to be aligned with a second edge of the wrapping material, said position changing means being operable to move at least one of said roll and said wrapper dispensing and cutting means; and a mechanical stopper for stopping movement by said position changing means of at least one of said roll and said wrapper dispensing and cutting means so that at least one of (a) a first edge of the roll is aligned with a first edge of the wrapping material and (b) a second edge of the roll is aligned with a second edge of the wrapping material.

7. The apparatus of claim 6, wherein said position changing means is operable to move the roll to be wrapped.

8. The apparatus of claim 6, wherein said position changing means is operable to move said wrapper dispensing and cutting means.

9. The apparatus of claim 6, further comprising means for supporting the roll on said support roller.

10. The apparatus of claim 7, comprising a first mechanical stopper operable to stop movement by said position changing means of the roll so that the first edge of the roll is aligned with the first edge of the wrapping material and a second mechanical stopper operable to stop movement by said position changing means of the roll so that the second edge of the roll is aligned with the second edge of the wrapping material.

11. The apparatus of claim 6, wherein said mechanical stopper is selected from the group of a pivotable arm, a pneumatic cylinder, a hydraulic cylinder, and a linearly moving arm.

12. The apparatus of claim 10, wherein said first and second mechanical stoppers are selected from the group of a pivotable arm, a pneumatic cylinder, a hydraulic cylinder, and a linearly moving arm.

13. An apparatus for wrapping a roll with a wrapping material comprised of one of paper and cardboard to protect the roll during shipping and handling, comprising:

means for transporting the roll to be wrapped to a wrapping station;

a wrapping station comprising support rollers and a wrapper dispensing and cutting means for dispensing a length of wrapping material to wrap the roll and for cutting the wrapping material, the length of the wrapping material being perpendicular to an axis of the roll;

a transporter for moving the roll in a path in a direction along the axis of the roll;

means for changing the relative position of the roll and the wrapper dispensing and cutting means to enable at least one of (a) a first edge of the roll to be aligned with a first edge of the wrapping material and (b) a second edge of the roll to be aligned with a second edge of the wrapping material, said position changing means being operable to move at least one of said roll and said wrapper dispensing and cutting means; and a mechanical stopper actuatable to extend into the path of the roll and stop movement of the roll so that at least one of (a) a first edge of the roll is aligned with a first edge of the wrapping material and (b) a second edge of the roll is aligned with a second edge of the wrapping material.

14. The apparatus of claim 13, wherein said mechanical stopper is selected from the group of a pivotable arm, a pneumatic cylinder, a hydraulic cylinder, and a linearly moving arm.

* * * * *